United States Patent [19]

Dittell

[11] Patent Number: 4,633,676

[45] Date of Patent: Jan. 6, 1987

[54] COOLING AND HEATING APPARATUS

[76] Inventor: Edward W. Dittell, 6280 NE. 6th St., Minneapolis, Minn. 55432

[21] Appl. No.: 673,233

[22] Filed: Nov. 19, 1984

[51] Int. Cl.[4] ..... F25B 27/00

[52] U.S. Cl. ..... 62/238.6; 62/181; 62/260

[58] Field of Search ..... 62/235.1, 238.6, 79, 62/228.1, 230, 158, 181, 183; 237/2 B

[56] References Cited

U.S. PATENT DOCUMENTS

| | | | |
|---|---|---|---|
| 2,847,831 | 8/1958 | Carraway | 62/181 X |
| 3,916,638 | 11/1975 | Schmidt | 62/238.6 |
| 3,989,183 | 11/1976 | Gustafsson | 62/238.6 |
| 4,134,273 | 1/1979 | Brautigam | 62/260 X |
| 4,209,996 | 7/1980 | Shaw | 62/238.6 |
| 4,241,588 | 12/1980 | Murphy et al. | 62/238.6 |
| 4,299,277 | 11/1981 | McGregor | 62/260 X |
| 4,325,228 | 4/1982 | Wolf | 62/260 |
| 4,363,218 | 12/1982 | Nussbaum | 62/238.6 X |
| 4,375,831 | 3/1983 | Downing, Jr. | 62/260 X |
| 4,376,435 | 3/1983 | Pittman | 62/235.1 X |
| 4,382,368 | 5/1983 | Dittell | 62/238.6 |
| 4,429,547 | 2/1984 | Granryd | 62/238.6 |

*Primary Examiner*—Lloyd L. King

*Attorney, Agent, or Firm*—Kinney & Lange

[57] ABSTRACT

An energy transfer apparatus transfers energy from and to a source liquid, such as well water. The apparatus includes a refrigeration system having an evaporator, a compressor, a thermal expansion valve, a main condenser and a superheated condenser. The well water is provided through conduit into heat exchange relationship with the evaporator and then transported into a first set of cooling coils for cooling air. First and second storage tanks have a heat-absorbable fluid. Suitable conduit is used to transport the heat absorbable fluid into heat transfer relationship with the superheated condenser and the main condenser, respectively. The heated absorbable fluid is stored in the first and second storage tanks for use as an energy source. The heat-absorbable fluid is then transferred through conduit to a heating unit which transfers heat to air conveyed over the heat exchanger.

18 Claims, 5 Drawing Figures

TO FAUCET
HOT
WARM
CITY WATER

COOLING AND HEATING APPARATUS

BACKGROUND OF THE INVENTION

1. Field of the Invention.

The present invention pertains to a system that transfer heat to and from a source liquid, such as well water, thus providing both heating and cooling individually or simultaneously.

2. Description of the Prior Art.

The extraction of heat from water, such as well water, to heat buildings, both residential and commercial, has been explored in recent years. In addition, cooling buildings by using well water has also been known. These systems, often referred to as geothermal heating or cooling systems, have been, for the most part, inefficient. For example, the extraction of heat from water using a refrigeration system, commonly referred to as a heat pump system, has not been practical due to the requirement of maintaining a high head pressure on the compressor to continuously maintain a tank of water at a predetermined temperature. An excessive amount of energy is used in starting the compressor each time the tank is needed to be brought up to temperature.

One system described in the Dittell U.S. Pat. No. 4,382,368, which was was issued to the applicant of the present application, describes an efficient system for extracting heat from well water using a refrigeration cycle that extracts heat from the well water and stores the heat in water contained in storage tanks. This system, however, does not provide for a way of cooling a building and thus a separate cooling system is needed.

SUMMARY OF THE INVENTION

The present invention includes an energy transfer system for transferring energy from and to a source liquid, such as well water, providing both cooling or heating or both simultaneously. The system includes a refrigeration system having an evaporator and a condensor for extracting heat from the well water through the evaporator and dissipating heat through the condenser. The well water is transported through conduit into heat transfer relationship with the evaporator for extracting heat from the well water. The well water then flows from the evaporator to a heat exchanger. Air is transported over the heat exchanger with heat being extracted from the air and the air then conveyed to cool the building. Water stored in storage tanks is conveyed through conduit into heat transfer relationship with the condenser from which heat is extracted and absorbed by the water for future use. The heat-containing water is then transported on demand to a heating unit and the heat extracted from the water by passing air over coils and transferring the heat into a facility.

DETAILED DESCRIPTION OF THE PREFERRED EMBODIMENTS

Figure 1:
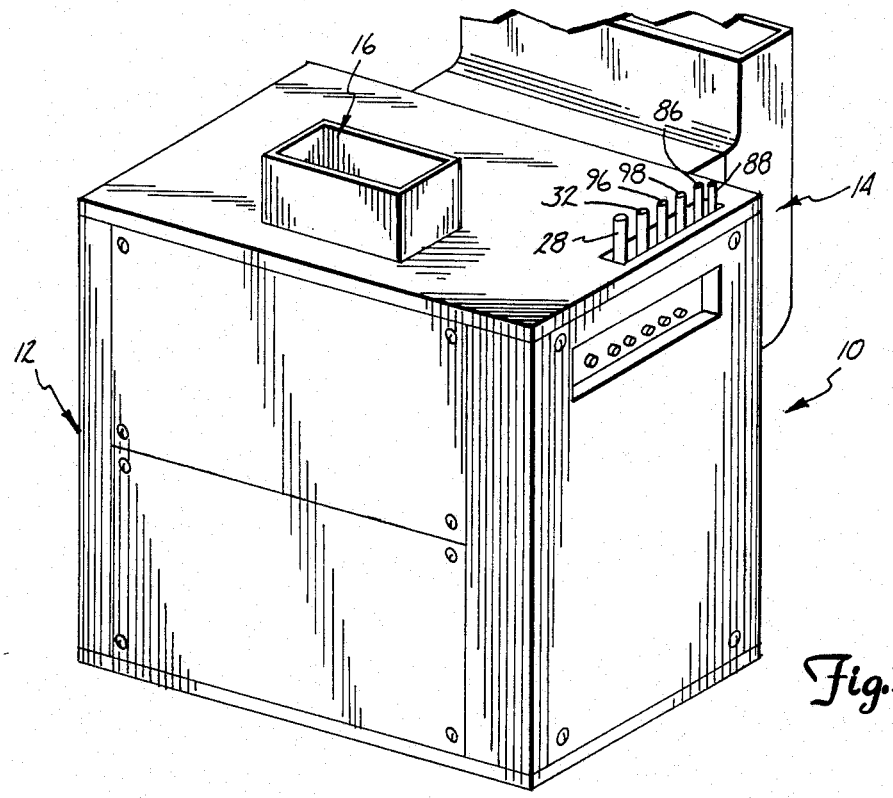
FIG. 1 is a perspective view of a preferred embodiment of a cabinet enclosing a refrigeration system and a heating unit of the present invention.

The energy transfer system of the present invention is generally indicated at 10 in a preferred cabinet construction 12 illustrated in FIG. 1. The cabinet 12 is only one preferred embodiment and can take other forms than that specifically shown in FIG. 1. The specific embodiment of the cabinet 12 illustrated in FIG. 1 is used in cooperation with a duct work system for supplying heated air throughout a building represented by an air supply duct 14 and a heated air discharge duct 16. The supply air is conveyed into the cabinet 12 over a heating unit, typically a heat exchanger and a fan for conveying air over the heat exchanger (not shown), that heats the air which is discharged through the duct 16. The cabinet 12 also contains various other elements of the present invention which are described subsequently.

Figure 2:
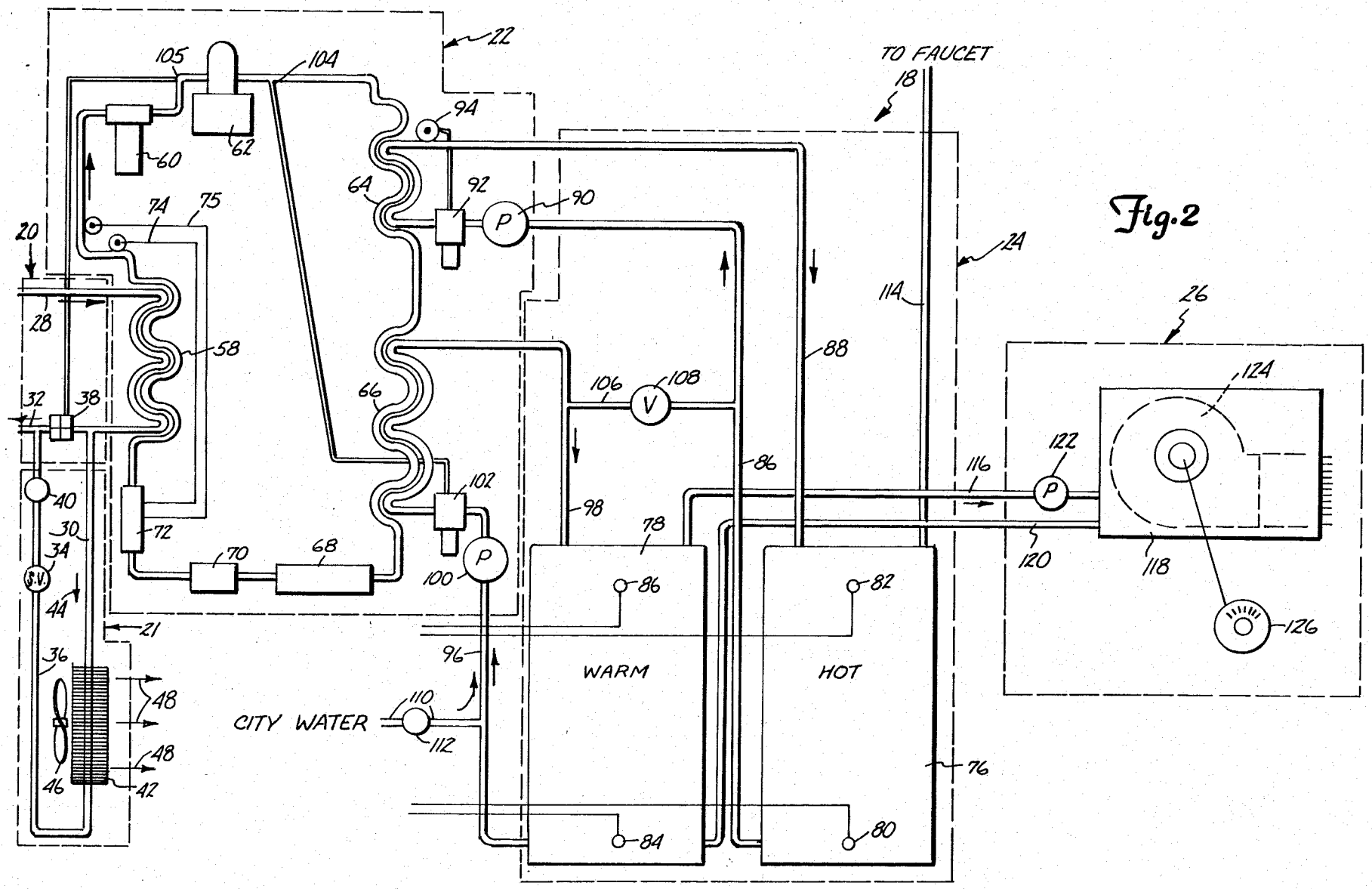
FIG. 2 is a schematic diagram of the apparatus of the present invention.

Referring to FIG. 2, a schematic diagram of a preferred embodiment of the present invention is generally illustrated at 18. The embodiment 18 includes a source water section 20, a cooling section 21, a refrigeration section 22 for extracting heat from the source water section 20, an energy storage section 24 and a heat delivery section 26 for providing heat to a site within a building or facility. It will be appreciated that the present invention 18 is constructed in modular form. One or more of each of the sections 21, 22, 24 and 26 are combinable to fulfill the heating and/or cooling requirements of a facility or building.

The source water section 20 supplies water from a well or other water source through conduit 28 for heat transfer therefrom by refrigeration section 22. The source water may be potable or may be contaminated, the quality not being of any particular importance with regard to the present invention since the source water is never mixed with any water or liquids used in the storage section 24 or the heat delivery section 26. In addition, the source water may be any industrial liquid from which heat can be extracted or shallow well water containing pollutants. An expensive well providing clean deep well water obtained from an aquifer is not needed.

From the source water section 20, the well water is conveyed to the cooling section 21 through conduit 30. Alternatively, the water may be diverted, if cooling is not needed, through conduit 32 to a drain or otherwise disposed of. The flow of well water to the cooling section is regulated by a solenoid valve 34 positioned in conduit 36 and a modulating valve 38 located in conduit 32. A manual control valve 40 is positioned in conduit 36 downstream of the solenoid valve 34. The cooling section 21 also includes a heat exchanger 42 through which the well water flows from conduit 30 to conduit 36 as indicated by arrow 44. A fan 46 forces air over the heat exchanger 42 for extraction of heat therefrom resulting in cooler air for use as an air conditioning medium, as indicated by arrows 48.

The refrigeration section 22 includes an evaporator 58, an accumulator 60, a compressor 62, a superheated condenser 64, a main condenser 66, a receiver 68, a filter dryer 70 and a thermal expansion valve 72. The refrigeration section 22 is described in the Dittell U.S. Pat. No. 4,382,368, which was issued to the applicant of the present application, and is herein incorporated by reference. The evaporator 58 is preferably a coaxial double tube heat exchanger wherein the well water flows through an inner conduit and the refrigerant flows between the inner and an outer conduit, evaporating and extracting heat from the well water. Similarly, the superheated condenser 64 and the main condenser 66 are also coaxial double tube heat exchangers with the refrigerant flowing between an outer conduit and water flowing through an inner conduit with heat being transferred from the refrigerant to the water in the inner conduit. As can be seen from the diagram in FIG. 2, the superheated condenser 64 and the main condenser 66 are connected in series with the superheat being extracted from the refrigerant in the superheated condenser 64 and the remaining heat from the refrigerant being extracted in the main condenser 66.

A thermal expansion valve 72 is positioned upstream of the evaporator. The valve 72 is operated through a temperature sensor 74 and a pressure sensor 75 positioned downstream of the evaporator so that the evaporator 58 is operated at maximum efficiency.

The energy storage section 24 includes preferably a hot water tank 76 and a warm water tank 78. Aquastats 80 and 82 are provided for tank 76 and aquastats 84 and 86 are provided for tank 78. Aquastats 80, 82, 84 and 86, upon sensing water of a lower than selected temperature, activate the compressor. Water from the hot water tank is conveyed through conduit 86 through the inner conduit of the superheated tank 76 through return conduit 88 which returns the water near the condenser 64 and back to the top of the tank. A pump 90 provides the motive force to pump the water from the bottom of the tank to the condenser 64 and back to the top of the tank. A modulating valve 92 controls the flow of water through the superheated condenser 64 by way of a temperature sensor 94 preferably positioned downstream of the condenser 64.

The warm water tank is fluidly connected by conduit 96 to the center conduit of the main condenser 66 for extracting heat from the refrigerant and is transported back to the top of the tank 78 through conduit 98. A pump 100 provides the motive force for pumping the liquid from the bottom of the tank through the main condenser 66 and back to the top of the tank. A modulating valve 102 controls the flow through the main condenser 66 by sensing head pressure of the compressor 62 proximate point 104 before the superheat condenser 64. The modulating valve 102 provides protection to the compressor 62 in that as the pressure gets greater, the valve 102 permits more water to flow through the main condenser 66.

Additionally, the modulator valve 38 also protects the compressor by sensing suction pressure of the compressor 62 proximate point 105 permitting more flow of water through the evaporator 58 if the suction pressure falls below a selected value.

In one application, the tank 78 and the tank 76 are fluidly connected through a conduit 106. Flow of water from the tank 78 to tank 76 is controlled by a valve 108. Make-up water to tank 78 is supplied from a potable source, such as a city water line, indicated by reference character 110. A valve 112 is positioned in the line 110 to control the flow of the make-up water into the tank 78. Hot water from the tank 76 is conveyed through conduit 114 to a user source, such as a faucet within a facility or building. It will be appreciated that the fluid connection between the tanks 78 and 76 provides for efficient extraction of heat from the refrigeration section 22. Warm water from tank 78 is provided to the tank 76 so that the water in tank 76 does not need to be heated as much to provide water at a high temperature. In other words, the temperature recovery of the water in tank 76 to a selected temperature, such as 140° F., is relatively short, since the temperature of the water in tank 78 is typically at 105° F.

As discussed previously, the aquastats 80, 82, 84 and 86 sense the temperatures within the tanks 76 and 78 and activate the compressor of the refrigeration section for transferring heat from the well water to the water flowing to and from tanks 76, 78, through the superheated condenser 64 and the main condenser 66. It will be appreciated that the refrigeration section 22 is turned on not through user demand of hot or warm water fom tanks 76 and 78, but through the aquastats thereby reducing the amount of times that the compressor in the refrigeration section 22 is turned on. The refrigeration section is operated for long cycles, reducing power consumption of the compressor due to numerous start-ups.

The heat delivery section 26 is fluidly connected through conduits 116 and 120 to the tank 78. The conduits 116 and 120 supply a heat exchanger (not specifically shown) within a heat delivery unit 118 with heated water. A pump 122 provides motive force for conveying the water from the top of tank 78 to the unit 118. The unit 118 also includes a fan 124 that transfers room air over the heat exchanger (not specifically shown) for heating the air. A thermostat 126 operates the unit 118 and the pump 122 to maintain the particular area in the facility or building at a temperature selected through the thermostat 126. It will be appreciated that heating demand by the thermostat 126 does not directly turn on the refrigeration section 22, but instead draws on the reservoir of heated water within the tank 78 so that the refrigeration section 22 operates independently in an economic and efficient manner as described previously.

Although the unit 118 is shown as a remote site unit, it may be contained within a cabinet such as previously discussed with reference to FIG. 1. In the embodiment in FIG. 1, the cabinet 12 contains the cooling section 21, the refrigeration section 22 and the unit 118 including the heat exchanger and fan. Unit 118 draws air through duct 14 and expells the heated air through duct 16. Well water is supplied to the cabinet 12 through conduits 28 and 32 and the water contained in tanks 76 and 78 are fluidly connected through conduits 86 and 88, and 96 and 98, respectively. The cabinet 12 is designed to replace a conventional furnace within a facility or building.

The cooling section 21 is operable in what is termed a first stage air conditioning mode or a second stage air conditioning mode depending on the demand of cooled air.

In the first stage air conditioning mode, the refrigeration section 22 is not turned on. If the source water is well water at 50° F., the air is cooled without further reduction in temperature by the refrigeration section 22. If the demand is more than can be accommodated by simply cooling the air using the well water at its ambient temperature of 50° F., the refrigeration section is turned on, such as by a thermostat, to develop second stage air conditioning. Heat is extracted from the water using the refrigeration section 22, as described previously, cooling the well water to a temperature below 50° F., thereby satisfying the cooling need. It will also be appreciated that the further cooling of the well water by the refrigeration section 22 provides a further dehumidification phenomena since the cooler well water can extract more moisture from the room air to increase the comfort level of the facility or building. In addition, the refrigeration section 22 transfers the heat extracted from the well water to the tanks 76 and 78 providing the facility or building with hot water while cooling the building, and thereby using the refrigeration section in a further economical and efficient manner.

Figure 3:
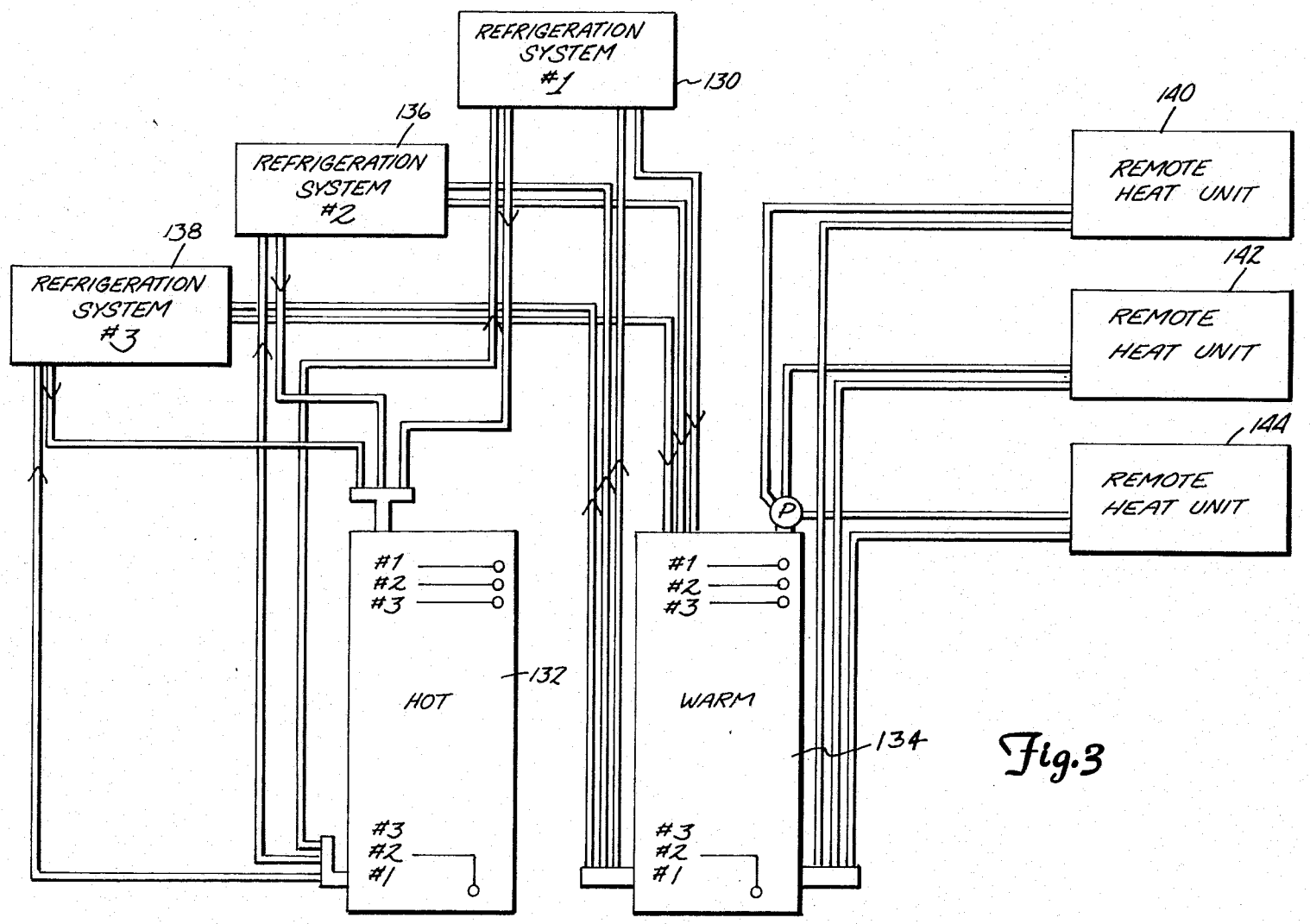
FIG. 3 is a schematic diagram of a modular form of the apparatus of the present invention.

In an alternative embodiment, diagrammatically illustrated in FIG. 3, the present invention is illustrated in a modular form. The modular format permits usage of remote site heating units operated independently of each other, or in unison. In addition, a plurality of refrigeration sections extract heat from the source water for storage in the hot and warm tanks.

For example, a first refrigeration system 130 is fluidly connected to hot and warm water tanks 132 and 134 in a similar manner as described with reference to FIG. 2. In addition, a second refrigeration system 136 and a third refrigeration system 138 are also fluidly connected to the hot and warm water tanks 132 and 134. The refrigeration systems use the same or different well source water. First, second, and third remote heating units 140, 142, and 144, all respectively, are fluidly connected to the warm water tank 134 and operate in a manner similar to what was described with reference to FIG. 2. The hot water tank 132 is used also in a similar manner as the hot water tank 76 for providing the facility or building with hot water.

Each of the refrigeration systems 130, 136 and 138 are turned on and off through individual aquastats referenced in FIG. 3, the same as the respective refrigeration systems. The upper aquastats are set at selected temperatures and are disposed at different heights in the tank. The upper aquastats are used to turn on the respective refrigeration systems as necessary to transfer sufficient heat from the source water to the tanks 132 and 134 as needed. For example, the first upper aquastat turns on the first refrigeration system as a cooler temperature of the water within the respective tanks reaches the first aquastat. The second aquastat turns on the second refrigeration system when the water temperature at the level of the second aquastat falls below the setting of the second aquastat. Similarly, the third upper aquastat turns on the third refrigeration system to transfer heat from the source water to the water in the tanks when the temperature of the water at the level of the third aquastat goes below the setting of the third aquastat. When the water in the tanks 132 and 134 is heated and the temperature of the water reaches the setting of the lower aquastat, the refrigeration systems 130, 136 and 138 are shut off by the lower aquastat. The modular approach discussed above uses a minimum amount of electrical energy to transfer incremental amounts of heat from the source water to the storage tanks. Unlike prior art heat pump systems that have a single compressor whose capacity is based on maximum demand and whose maximum capacity is used regardless of the incremental heat needed, the modular approach of the present invention efficiently uses compressor capacity based on the incremental demand for heat.

Figure 4:
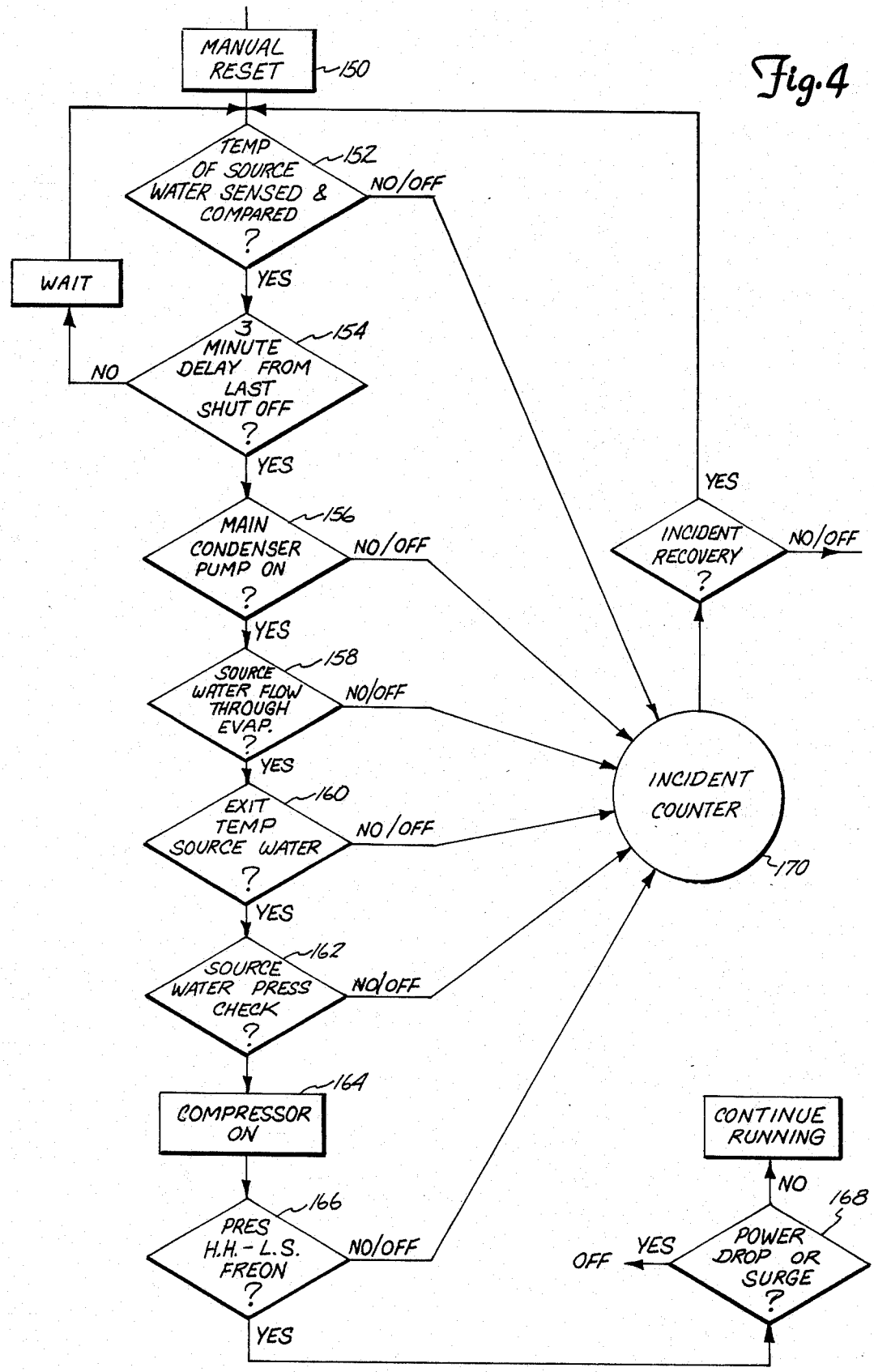
FIG. 4 is a logic diagram of a compressor lock out circuit of the present invention.

The compressor 62 of the refrigeration system of the present invention is protected by a unique compressor lock out circuit which is illustrated in FIG. 4. The compressor 62 has a standard manual reset 150 which prevents starting of the compressor if the motor windings are overheated.

The temperature of the well water is then sensed as indicated by block 152 and is compared to a previously sensed temperature of the well water if the compressor had been previously disabled by a subsequent check as is discussed below. For example, if the source water temperature has changed 2° F. above or below the previously recorded temperature, the compressor is not allowed to restart. Well water does not change temperature significantly over A short time period and a 2° F. change in the well water indicates a problem that might damage the compressor.

If the temperature source water is within the selected tolerances, the time interval since the compressor was last turned on is checked, as indicated by block 154. The check can be either done through a counter or through a capacitor which delays start-up of the compressor until a selected voltage is reached. A three-minute delay is used in one preferred embodiment, but any other time interval considered safe may be used. A delay in starting the compressor provides for a chance for a processing condition that has disabled the compressor to self-correct.

If the delay check is positive, the status of the main condenser pump, pump 102 in FIG. 2, is checked as indicated by block 156. If the pump is not running, the compressor is not allowed to start.

The source water flow through the evaporator is also checked, as indicated by block 158. If the well water has been shut off or if the return conduit 32 is frozen and there is no flow through the evaporator, the compressor can be irreversibly damaged.

Next, the exit temperature of the source water leaving the evaporator is checked, as indicated by block 160. If the temperature of the well water is close to freezing, for example, 36° F., the compressor will be shut off before the evaporator can freeze.

The source water pressure is also checked as indicated by block 162. If the water pressure drops below a selected value, a blockage may be occurring which would prevent proper operation of the evaporator and cause damage to the compressor.

If all of the above discussed checks are positive, the compressor is turned on as indicated by block 164. Once the compressor has been turned on, a check for high head pressure or low suction pressure of the refrigerant (freon) is conducted, as indicated by block 166. If there is high head pressure or low suction, the compressor is shut off. If the refrigerant pressures are within selected values, the refrigeration system is allowed to run.

In addition, checks 156, 158, 160 and 162 are continuously conducted during the running of the refrigeration system and if any of the flow rates, pressures or temperatures fall out of selected values, the compressor is shut off.

In addition, power surges or power drops are also monitored as indicated by block 168. If the power being supplied to the compressor falls out of a selected range, the compressor is shut off.

If any of the checks 152, 156, 158, 160, 162 and 166 are negative, the result is recorded on an incident counter 170. The incident counter 170 provides a record of the number of failures that have occurred to the apparatus of the present invention. Once the incident counter has been incremented, the compressor lock out circuitry returns to check 152 and performs all the checks previously discussed. If the malfunction still exists, the compressor remains shut down.

Figure 5:
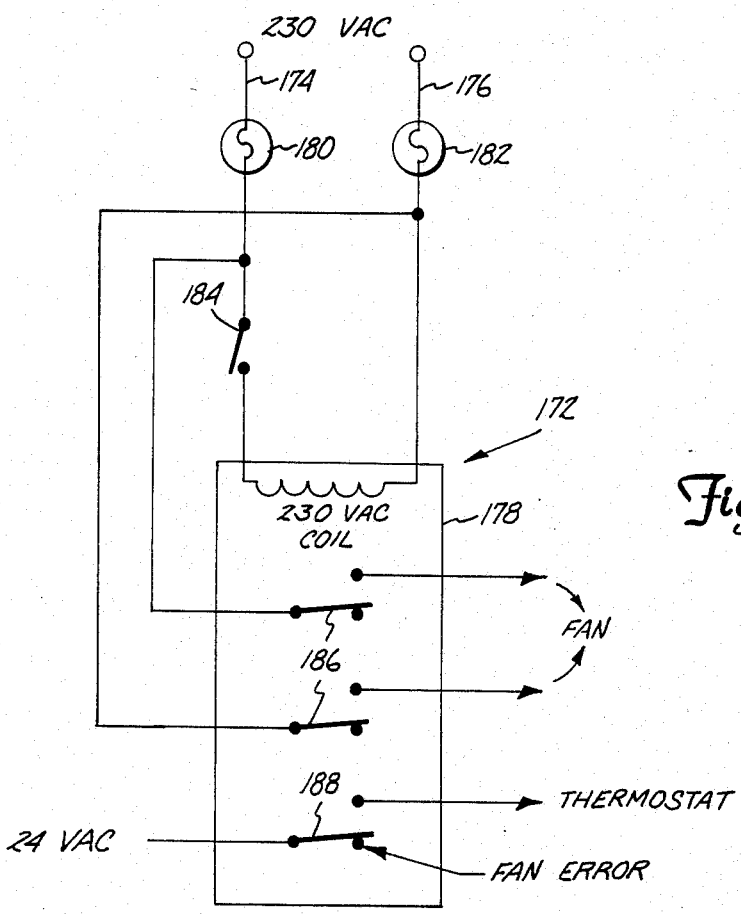
FIG. 5 is a schematic diagram of a fan lock out circuit of the present invention.

The present invention also includes a fan lock out circuitry, as schematically illustrated in FIG. 5. Unlike prior art heat pump systems which warm air by transferring the air directly over the condenser coils, the apparatus of the present invention stores the energy in storage tanks, as discussed previously, and then transfers heated water to a heating unit or units which each have a separate fan that is powered by a 230 V AC line which is also used to power the compressor. Since the running of the fan of the heating unit does not disable the refrigeration system, the fan lock out circuitry is designed not to affect the refrigeration system if a malfunction of the heating unit fan occurs.

The fan lock out circuitry 172 disables the thermostat that controls the pump which provides water flow from the storage tank to the heating unit. The fan lock out circuitry includes two 110 V AC lines 174 and 176 providing power from a 230 volt source to a three-pole double throw relay 178. Each line 174 and 176 has a fuse 180 and 182 for protection. A fan switch 184 for manually turning the fan is provided in one of the lines, for example in line 174. If either one of the fuses 180 or 182 disables, relay connection 186 that turns the heating unit fan on stays in the open position and relay connection 188 that enables the thermostat also stays in the open position. The relay connection 188, when in the open position, enables a fan error message (not shown) on a control panel to light up. The fan error control message receives power from a 24 volt source. The fan lock out circuitry provides further energy savings by only disabling the fan during a fan failure and prevents disabling of the refrigeration section so that heat continues to be transferred to the storage tanks as needed.

Although the present invention has been described with reference to preferred embodiments, workers skilled in the art will recognize that changes may be made in form and detail without departing from the spirit and scope of the invention.

What is claimed is:

1. An energy transfer apparatus for transferring energy from and to a source liquid to heat and cool a facility, the apparatus comprising:

means for providing a refrigeration cycle including means for evaporating refrigerant, means for condensing refrigerant and means for producing a phase change in the refrigerant;

means for cooling air;

means for providing a single continuous flow of the source liquid first to the means for evaporating refrigerant and next to the means for cooling air, said means for providing a continuous flow of the source liquid being in heat transfer relationship with the means for evaporating refrigerant such that heat is absorbed from the source liquid by the refrigerant prividing a cooled source liquid, said means for cooling air being in fluid communication with the cooled source liquid downstream of the means for evaporating refrigerant and using the cooled source liquid to cool the air;

means for storing a heat-absorbing liquid and connected in heat transfer relationship with the means for condensing refrigerant such that heat is transferred from the refrigerant to the heat-absorbing liquid.

2. The apparatus of claim 1 wherein the means for condensing refrigerant includes a super heated condenser and a main condenser serially connected.

3. The apparatus of claim 2 wherein the means for storing includes a first tank and a second tank wherein the first and second tanks each contain the heat absorbing fluid which is in heat transfer relationship with the superheated condenser and the main condenser, respectively.

4. The apparatus of claim 3 wherein the heat absorbing fluid is water and wherein the first tank is fluidly connected to means for using hot water and the second tank is fluidly connected to a water supply and including first conduit means for fluidly connecting the first tank to the second tank so that warm water is selectively transferred from the second tank to the first tank to be further heated.

5. The apparatus of claim 4 and including second conduit means fluidly connecting the first tank and the superheated condenser for transport of water between the first tank and the superheated condenser and further including first means for selective control of water flow between the first tank and the superheated condenser and having temperature sensing means for sensing exit temperature of the water from the condenser to the hot water tank and controlling the flow of the water based on a selected temperature value.

6. The apparatus of claim 5 and including third conduit means fluidly connecting the second tank and the main condenser for transport of water between the second tank and the main condenser and including second means for selectively controlling the flow of water between the second tank and the main condenser and having pressure sensing means for sensing compressor head pressure and selectively controlling the flow of water to the main condenser based on a selected value of compressor head pressure.

7. The apparatus of claim 3 and further including means for consuming heat stored in the means for storing having a hot water conduit for transport of the heat absorbing fluid to a point of heat transfer.

8. The apparatus of claim 1 wherein the means for producing a phase change includes a compressor and further including source liquid flow control means in a fluid communication with the source liquid downstream of the evaporator for selectively controlling the flow of the source liquid and including pressure sensing means for sensing pressure on a suction side of the compressor such that the source liquid flow is selectively controlled based on a selected value of pressure on the suction side of the compressor.

9. The apparatus of claim 8 wherein the means for consuming heat stored includes a heat exchanger, a fan for transporting air over the heat exchanger, a pump for pumping fluid through the conduit that transports heated water from the means for storing and a thermostat operably connected to the pump for selectively controlling the operation of the pump based on selected temperature values and wherein the fan is provided power through a separate fuse circuit not connected to circuitry operating the means for providing a refrigeration cycle such that if a fuse in the fused circuit is disabled, the fan and thermostat are disabled without affecting the operation of the means for providing a refrigeration cycle.

10. The apparatus of claim 8 wherein the refrigeration system and the means for consuming heat stored receive electrical power from the same source and are connected to said electrical source in a parallel relationship such that a malfunction of the refrigeration system does not affect the operation of the means for consuming heat and a malfunction in the means for consuming heat does not affect the operation of the refrigeration system.

11. The apparatus of claim 8 wherein the means for consuming heat includes a plurality of heating units.

12. An improvement in a heat transfer apparatus having a refrigeration system with a compressor, an evaporator and at least one condenser, means for storing a heat-absorbing liquid, said heat-absorbing liquid in heat transfer relationship with at least the one condenser, and a heating unit receiving the heat-absorbing liquid from the means for storing, the heating unit incluidng a heat exchanger, a fan for transporting air over the heat exchanger, a conduit fluidly connecting the heat exchanger in heat transfer relationship with the condenser, a pump for pumping heat absorbing fluid through the conduit and a thermostat operably connected to the pump for selectively controlling the operation of the pump based on selected temperature values, means for providing a source liquid in heat transfer relationship with the evaporator, the improvement comprising:

a separate fused circuit electrically connecting the fan to a power source in parallel relationship to circuitry providing power to the refrigeration system such that if the fan malfunctions, a fuse in the fused circuit is disabled, disabling the thermostat without affecting the operation of the refrigeration system or if the refrigeration system is disabled, the thermostat is not affected permitting the fan to operate.

13. A method for minimizing damage in a refrigeration section which transfers energy from a source liquid, the refrigeration section including an evaporator, a compressor, a flow control means, and means for measuring the status of the flow control means, existence of flow through the evaporator, temperature of the source liquid, and pressure of the source liquid, said method comprising:

(a) checking the operability of the flow control means controlling the flow of liquid to the main condensor;

(b) checking the existence of source liquid flow through the evaporator;

(c) checking the temperature of the source liquid at an exit of the evaporator;

(d) checking the magnitude of the source liquid pressure prior to the evaporator; and (e) disabling the compressor if any of steps (a) through (d) above result in a negative response.

14. The method of claim 13 and further including:

(f) checking head pressure and suction pressure of the compressor and comparing the respective pressures to selected values and disabling the compressor if the pressures do not meet the selected values.

15. The method of claim 14 and further including the step of:

(g) sensing the temperature of the source liquid if the compressor is disabled due to steps (a), (b), (c), (d), or (f) and comparing the sensed temperature to the temperature previously sensed in step (c).

16. The method of claim 15 and further including:

(h) delaying start-up of the compressor for a selected period of time if any of the steps (a), (b), (c), (d), (f) or (g) disable the compressor.

17. The method of claim 16 wherein the apparatus includes a counter and further including:

(i) incrementing the counter if a negative response results from any of the steps (a), (b), (c), (d), (f) or (g).

18. The method of claim 17 and further including:

(j) disabling the compressor as a result of a power drop or surge below or above a selected value of voltage.

* * * * *